US006433523B2

(12) United States Patent
Hashimoto

(10) Patent No.: US 6,433,523 B2
(45) Date of Patent: Aug. 13, 2002

(54) SEMICONDUCTOR INTEGRATED CIRCUIT AND METHOD FOR GENERATING INTERNAL SUPPLY VOLTAGE

(75) Inventor: Yuki Hashimoto, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 09/774,753

(22) Filed: Feb. 1, 2001

(30) Foreign Application Priority Data

Jul. 21, 2000 (JP) ..... 2000-220698

(51) Int. Cl.[7] ..... G05F 1/40; G05F 1/618

(52) U.S. Cl. ..... 323/282; 323/274; 323/285

(58) Field of Search ..... 323/281, 284, 323/282, 274, 275, 285

(56) References Cited

U.S. PATENT DOCUMENTS

| | | | | | |
|---|---|---|---|---|---|
| 4,536,699 | A | * | 8/1985 | Baker | 323/281 |
| 4,731,574 | A | * | 3/1988 | Melbert | 323/275 |
| 5,084,666 | A | * | 1/1992 | Bolash | 323/283 |
| 5,103,157 | A | * | 4/1992 | Wright | 323/275 |
| 6,025,707 | A | * | 2/2000 | Joo | 323/283 |
| 6,034,519 | A | * | 3/2000 | Yang | 323/316 |
| 6,222,353 | B1 | * | 4/2001 | Pattamatta et al. | 323/269 |
| 6,281,665 | B1 | * | 8/2001 | Miyaba et al. | 323/224 |

* cited by examiner

*Primary Examiner*—Bao Q. Vu
(74) *Attorney, Agent, or Firm*—Volentine Francos, PLLC

(57) ABSTRACT

A system supply voltage, supplied from an external supply circuit, is lowered to generate an internal supply voltage for an internal circuit when the system supply voltage is higher than a breakdown voltage of the internal circuit. The system supply voltage is directly supplied to the internal circuit when the system supply voltage is not higher than the breakdown voltage of the internal circuit.

15 Claims, 4 Drawing Sheets

SEMICONDUCTOR INTEGRATED CIRCUIT AND METHOD FOR GENERATING INTERNAL SUPPLY VOLTAGE

CROSS REFERENCE TO RELATED APPLICATION

This application claims the priority of Application No. 2000-220698, filed Jul. 21, 2000 in Japan, the subject matter of which is incorporated herein by reference.

TECHNICAL FIELD OF THE INVENTION

The present invention relates to a semiconductor integrated circuit (IC), and more particularly to an IC provided with a voltage-drop or voltage lowering circuit which lowers a system supply voltage to generate an internal supply voltage.

BACKGROUND OF THE INVENTION

For improving the performance of an IC, such as a memory IC, it is required to provide higher integration and lower power consumption. Especially, it is understood that lower power consumption and high-speed operation is most important.

To improve the degree of integration of an IC, transistors are fabricated to be small in size. In a conventional IC using a 5V of standard supply voltage, it is difficult to ensure the reliability of the IC, because small size of transistors have lower breakdown voltages. Especially, memory ICs of 16M bit or higher have very low breakdown voltages. It has been required to provide both lower power consumption and higher reliability by generating optimum supply voltage for each type of IC. However, it is not practically good to use different power supply circuit for each IC. Accordingly, in recent years, a voltage-drop circuit or voltage lowering circuit has been propose d and put in use. Such a voltage lowering circuit lowers a system supply voltage, supplied from an external supply circuit, to an appropriate internal supply voltage to be used for operation of t he IC.

In a conventional IC includes a voltage lowering circuit lowers a system voltage VCC (for example, 5V) to an internal supply voltage IVCC (for example 2.0V), which is lower than a breakdown voltage VB (for example, 2.5V) of a memory circuit. The internal supply voltage IVCC, generated in the voltage lowering circuit, is supplied to the memory circuit.

According to the conventional IC, different levels of system voltages VCC can be used for operating the internal circuitry. If the system voltage VCC is lower than the breakdown voltage VB of the memory circuit, the voltage lowering circuit is unnecessary to use. If the system voltage VCC of 2V, which is lower than the breakdown voltage VB of the memory circuit, is used, the voltage lowering circuit would function as impedance; and as a result, the operation speed of the IC may be undesirably decreased. To avoid such a problem, the IC must be fabricated with a conductive pattern which makes a short circuit at the voltage lowering circuit. In other words, it is required to fabricate ICs using different patterns for different system voltages.

OBJECTS OF THE INVENTION

Accordingly, an object of the present invention is to provide a semiconductor integrated circuit which operates with an appropriate supply voltage without undesirable decrease of operation speed.

Another object of the present invention is to provide a method in which an optimum internal supply voltage is generated without undesirable decrease of operation speed.

Additional objects, advantages and novel features of the present invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

According to the present invention, a system supply voltage, supplied from an external supply circuit, is lowered to generate an internal supply voltage for an internal circuit when the system supply voltage is higher than a breakdown voltage of the internal circuit. The system supply voltage is directly supplied to the internal circuit when the system supply voltage is not higher than the breakdown voltage of the internal circuit.

According to the present invention, the integrated circuit such as an IC can be used for plural different levels of system supply voltages. When the system supply voltage VCC is lower than the breakdown voltage of the internal circuit, the system supply voltage VCC is directly supplied to the internal circuit without lowering or dropping of the system supply voltage; and therefore, it can be avoided that the operation speed of the IC is undesirably lowered.

The voltage-lowering step can be prohibited, when the system supply voltage is not higher than the breakdown voltage of the internal circuit. As a result, power consumption of a voltage lowering circuit is decreased (improved).

DETAILED DISCLOSURE OF THE INVENTION

In the following detailed description of the preferred embodiments, reference is made to the accompanying drawings which form a part hereof, and in which is shown by way of illustration specific preferred embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present inventions. The following detailed description is, therefore, not to be taken in a limiting sense, and scope of the present inventions is defined only by the appended claims.

Figure 1:
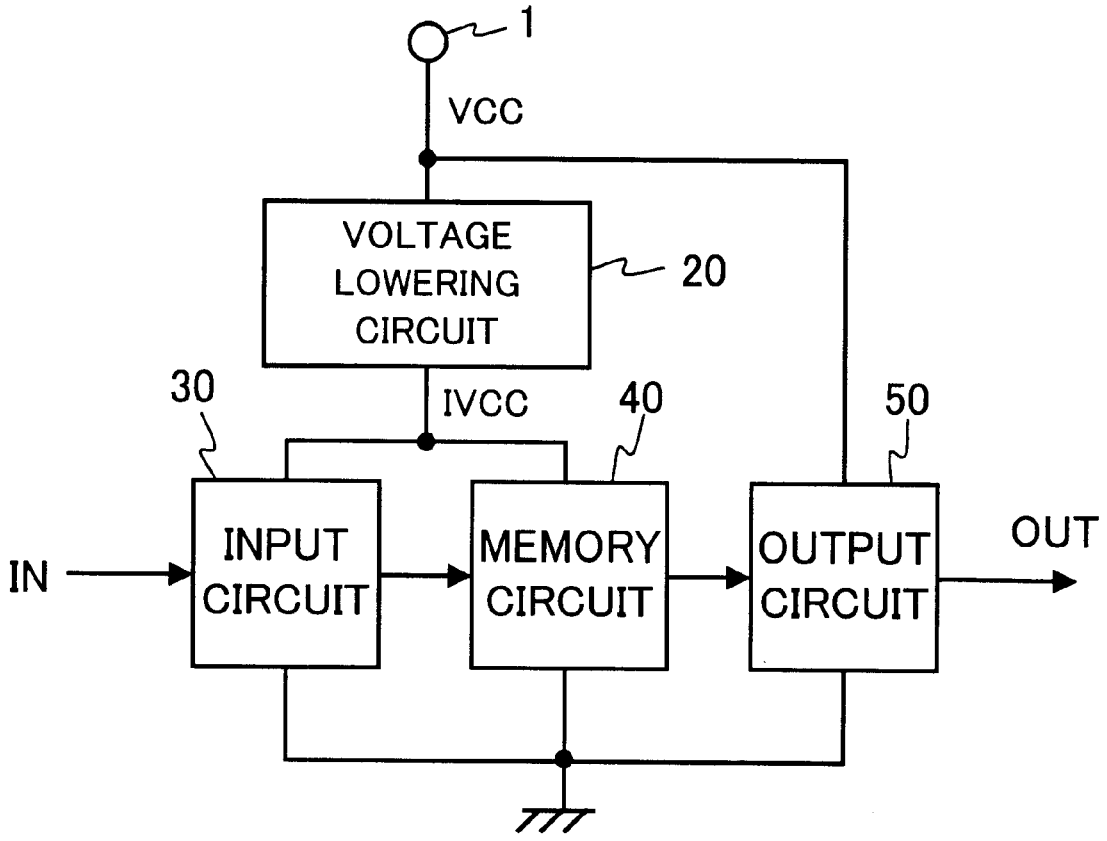
FIG. 1 is a block diagram showing a conventional IC.

For better understanding of the present invention, a conventional technology is first described in conjunction with FIG. 1. A conventional IC includes a voltage lowering circuit 20, an input circuit 30, a memory circuit 40 and an output circuit 50. The voltage lowering circuit 20 is connected at an input terminal to a lead frame 1, at which a system voltage VCC of 5V is applied. The lead frame 1 is connected to an input terminal of the output circuit 50. The voltage lowering circuit 20 is connected at an output terminal to input terminals of the input circuit 30 and memory circuit 40. The voltage lowering circuit 20 lowers the system supply voltage VCC to an internal supply voltage IVCC (for example 2.0V), which is lower than the breakdown voltage VB (for example, 2.5V) of the memory circuit 40.

The input circuit 30 is supplied with an input signal IN, and is connected at an output terminal to another input terminal of the memory circuit 40. The memory circuit 40 is connected at an output terminal to another input terminal of the output circuit 50. The output circuit 50 is supplied with the system voltage VCC to make interface condition match with external circuits. The internal supply voltage IVCC, generated in the voltage lowering circuit 20, is supplied both to the input circuit 30 and memory circuit 40.

According to the above described conventional IC, different levels of system voltages VCC can be used for operating the internal circuitry. If the system voltage VCC is lower than the breakdown voltage VB of the memory circuit 40, the voltage lowering circuit 20 is unnecessary to use. If the system voltage VCC of 2V, which is lower than the break down voltage VB of the memory circuit 40, is applied to the lead frame 1, the voltage lowering circuit 20 would only function as impedance; and as a result, the operation speed of the IC may be undesirably decreased. To avoid such a problem, the IC must be fabricated with a conductive pattern which makes a short circuit at the voltage lowering circuit 20. In other words, it is required to fabricate ICs using different conductive pattern designs for different system voltages.

First Preferred Embodiment

Figure 2:
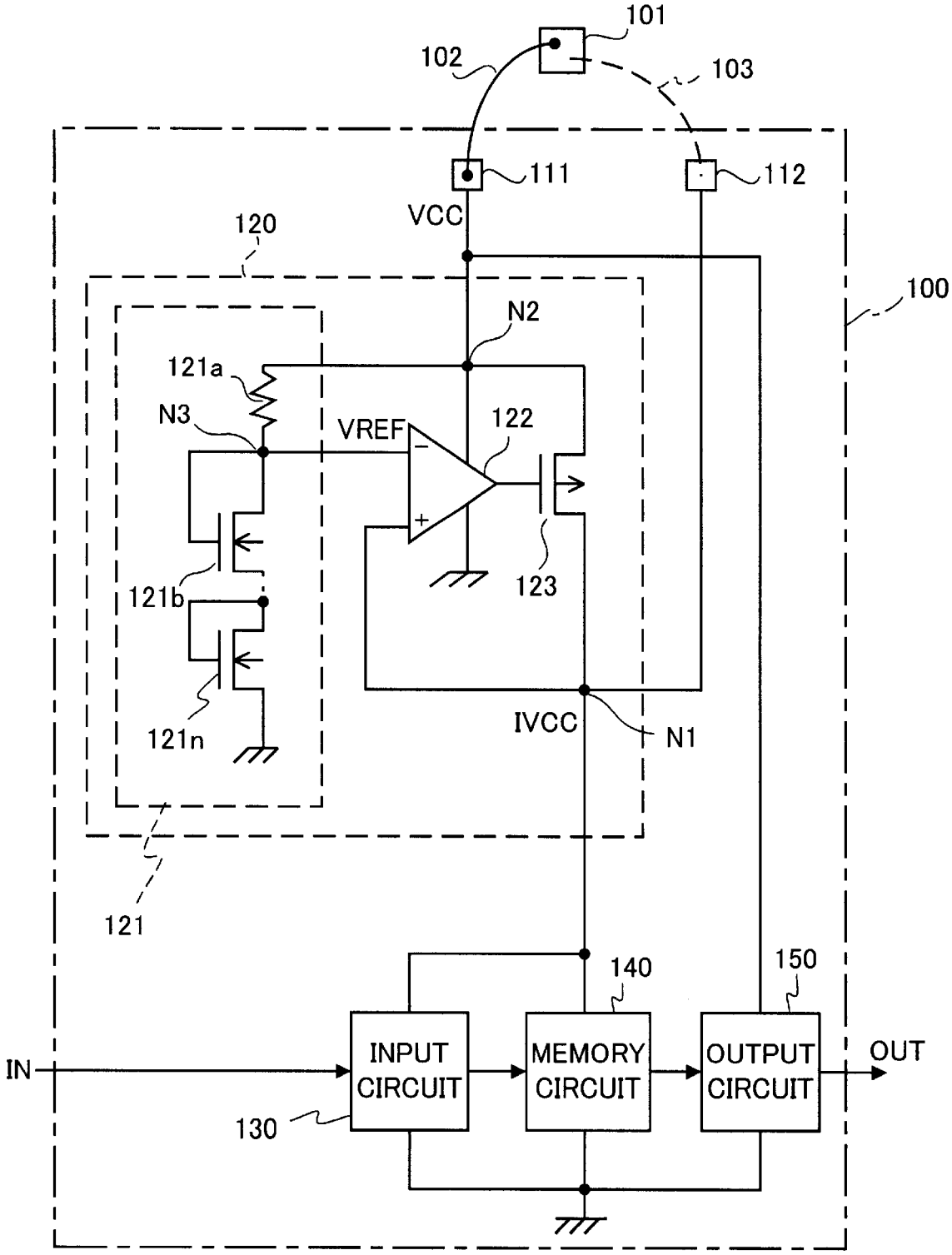
FIG. 2 is a block diagram showing an IC according to a first preferred embodiment of the present invention.

FIG. 2 is a block diagram showing a memory IC according to a first preferred embodiment of the present invention. An IC 100 according to the first preferred embodiment includes connection pads (electrodes) 111 and 112; a voltage lowering circuit 120; an input circuit 130; a memory circuit 140 and an output circuit 150. The connection pads 111 and 112 can be connected to a lead frame 101 with wires 102 and 103, respectively. The lead frame 101 is applied with a system supply voltage VCC. The connection pad 111 is connected to the voltage lowering circuit 120 and output circuit 150. The connection pad 112 is connected to a node N1 of the voltage lowering circuit 210. The node N1 is supplied with an internal supply voltage IVCC. The node N1 is connected to the input circuit 130 and memory circuit 140.

The memory circuit 140, for example, is a 16M bit type of DRAM having a breakdown voltage VB of 2.5V and is designed to operate with a 2.0V power. The input circuit 130 includes a limiter which restricts the level of an input signal IN. The output circuit 150 converts a voltage or potential of a signal outputted from the memory circuit 140 to a level corresponding to the system supply voltage VCC to provide an output signal OUT, supplied to external circuits.

The voltage lowering circuit 120 lowers the system supply voltage VCC when the system supply voltage VCC is higher than the breakdown voltage of the memory circuit 140 so as to generate an internal supply voltage IVCC that is appropriate to the memory circuit 140. The voltage lowering circuit 120 includes a reference voltage generating circuit 121; a comparator 122; and a PMOS transistor 123. The reference voltage generating circuit 121 generates a reference voltage VREF which corresponds to the internal supply voltage IVCC.

The comparator 122 is connected at a non-reverse input terminal to the node N1 and at an output terminal to a gate electrode of the PMOS transistor 123. The comparator 122 compares the internal supply voltage IVCC to the reference voltage VREF. The PMOS transistor 123 is connected at a source to a node N2 and at a drain to the node N1 The comparator 122 is connected at a power terminal to the node N2, which is connected to the connection pad 111.

The reference voltage generating circuit 121 includes a resistance 121*a* and serially connected plural (n) NMOS transistors 121*b*–121*n*. The resistance 121*a* is connected at an end to the node N2 and at the other end to a node N3. The NMOS transistor 121*n* is connected at a source to the ground. The node N3 is connected to a reverse input terminal of the comparator 122 and to a gate electrode of the NMOS transistor 121*b*. The reference voltage generating circuit 121 generates a reference voltage VREF corresponding to the sum of threshold voltages of the NMOS transistors 121*b*–121*n*. The reference voltage VREF is supplied to the node N3, when a system supply voltage VCC is applied to the connection pad 111.

The output circuit 150 is supplied with the system supply voltage VCC from the connection pad 111, which is connected to the lead frame 101 by a conductive wire 102.

Next, the operation of the IC 100 is described for two different cases using a system supply voltage of (1) standard supply voltage and (2) lower supply voltage.

(1) For Standard System Supply Voltage

When a system supply voltage VCC corresponding to a standard supply voltage of 5V is used, the connection pad 112 is not connected to the lead frame 101. The system supply voltage VCC applied to the lead frame 101 is supplied via the conductive wire 102 to the connection pad 111. The system supply voltage VCC is supplied to the voltage lowering circuit 120 and output circuit 150. The system supply voltage VCC is decreased or lowered with the PMOS transistor 123 to generate an internal supply voltage IVCC to be supplied to the input circuit 130 and memory circuit 140.

When the internal supply voltage IVCC is higher than the reference voltage, the comparator 122 outputs a higher level signal, so that a channel resistance of the PMOS transistor 123 is increased. As a result, the internal supply voltage IVCC is controlled to be lowered, since a voltage drop at the PMOS transistor 123 is increased.

When the internal supply voltage IVCC is lower than the reference voltage VREF, the comparator 122 outputs a lower level signal, so that a channel resistance of the PMOS transistor 123 is decreased. As a result, the internal supply voltage IVCC is controlled to be increased, since a voltage drop at the PMOS transistor 123 is decreased. According to such a feed-back control, the internal supply voltage IVCC is controlled to correspond or be identical to the reference voltage VREF.

The internal supply voltage IVCC is supplied to the input circuit 130 and memory circuit 140, while the system supply voltage VCC is supplied to the output circuit 150 for matching with external circuits.

(2) For Lower System Supply Voltage

When a low supply voltage, for example 2V, is used as a system supply voltage VCC, the connection pad 112 is connected with a conductive wire 103 to the lead frame 101.

The system supply voltage of 2V applied to the lead frame 101 is supplied both to the connection pads 111 and 112 through the conductive wires 102 and 103, respectively. The system supply voltage VCC at the connection pad 111 is supplied to the voltage lowering circuit 120 and output circuit 150. The system supply voltage VCC at the connection pad 112 is supplied via the node N1 to the input circuit 130 and memory circuit 140 regardless of the condition or function of the voltage lowering circuit 120. In other words, the system supply voltage VCC is directly supplied to the input circuit 130, memory circuit 140 and output circuit 150 without any level control.

In the IC 100 according to the first preferred embodiment, when the system supply voltage VCC is low in level, the system supply voltage VCC is supplied to the connection pad 112 through the conductive wire 103. Accordingly, the IC 100 can be used for two different levels of system supply voltage without any change of pattern design. In addition, when the system supply voltage VCC is low, the system supply voltage VCC is directly supplied to the memory circuit 140 without lowering or dropping of the voltage; and therefore, it can be avoided that the operation speed of the IC 100 is lowered.

Second Preferred Embodiment

Figure 3:
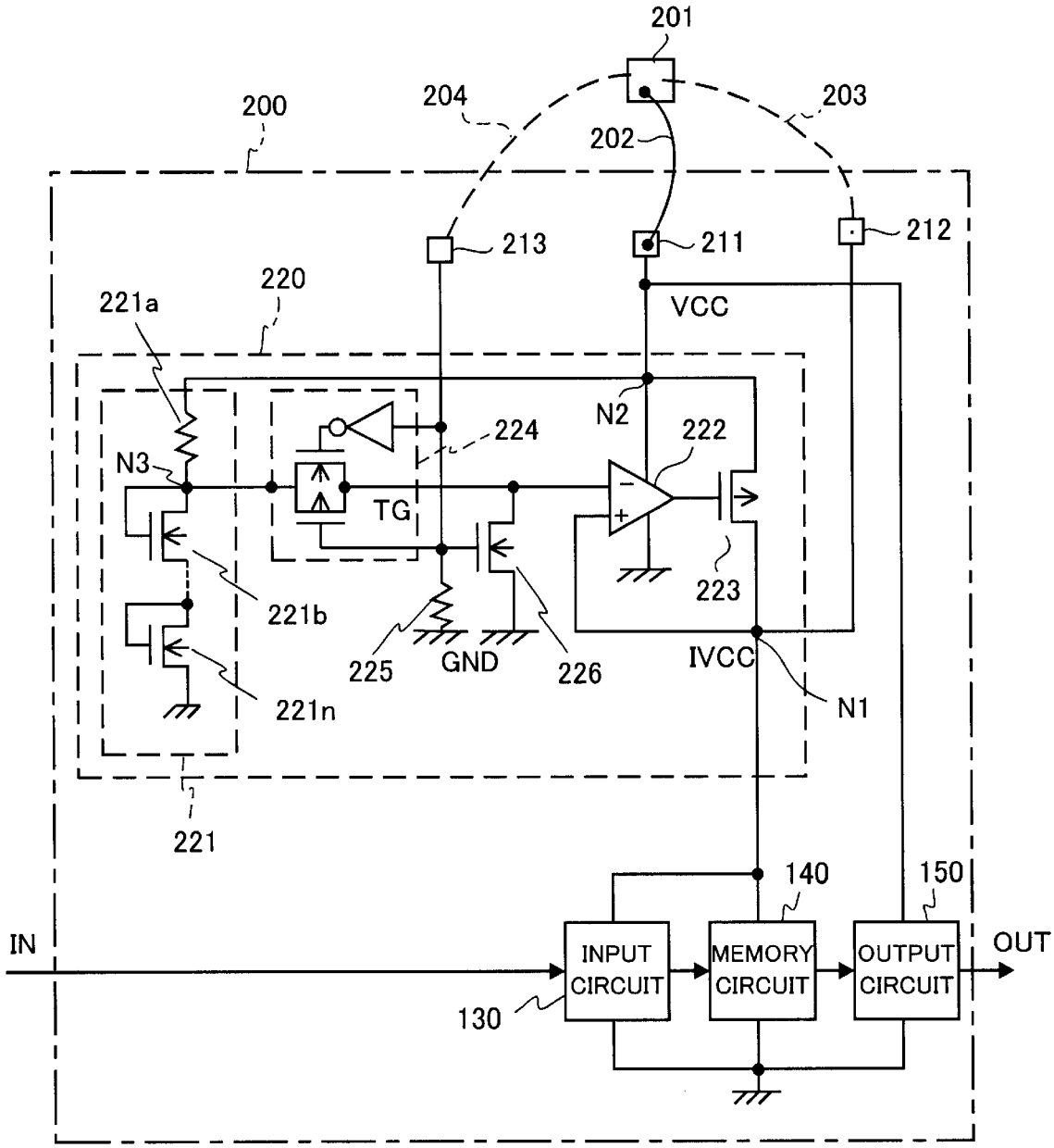
FIG. 3 is a block diagram showing an IC according to a second preferred embodiment of the present invention.
Figure 4:
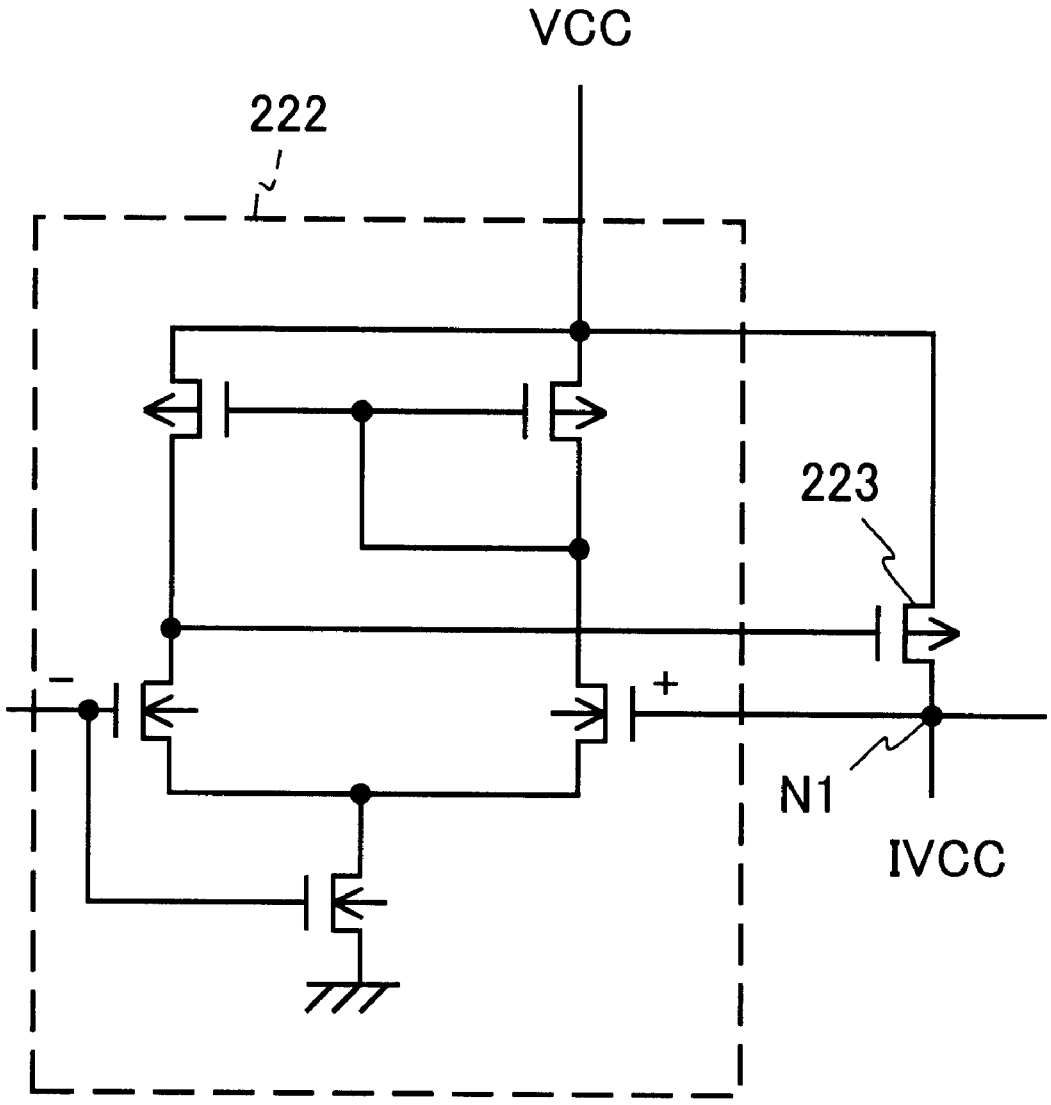
FIG. 4 is a circuit diagram showing a comparator used in the IC, shown in FIG. 3.

FIG. 3 is a block diagram showing an IC according to a second preferred embodiment of the present invention. FIG. 4 is a circuit diagram showing a comparator used in the IC, shown in FIG. 3. In FIGS. 3 and 4, the same and corresponding elements to those of the first preferred embodiment are represented by the same reference symbols, and the same description is not repeated here in this embodiment.

An IC 200 according to the second preferred embodiment includes connection pads 211, 212 and 213; a voltage lowering circuit 220; an input circuit 130; a memory circuit 140 and an output circuit 150. The connection pads 211, 212 and 213 can be connected to a lead frame 201 with wires 202, 203 and 204, respectively. The lead frame 201 is applied with a system supply voltage VCC. Each of the connection pads 211-213 is connected to the voltage lowering circuit 220.

The memory circuit 140, for example, is a 16M bit type of DRAM having a breakdown voltage VB of 2.5V and is designed to operate with a 2.0V power. The input circuit 130 includes a limiter which restricts the level of an input signal IN. The output circuit 150 converts a voltage or potential of a signal outputted from the memory circuit 140 to a level corresponding to the system supply voltage VCC to provide an output signal OUT, supplied to external circuits.

The voltage lowering circuit 220 includes a reference voltage generating circuit 221; a comparator 222; a PMOS transistor 223; a transfer gate 224; a resistance 225 and an NMOS transistor 226. The voltage lowering circuit 220 lowers the system supply voltage VCC when the system supply voltage VCC is higher than the breakdown voltage of the memory circuit 240 so as to generate an internal supply voltage IVCC that is appropriate to the memory circuit 240.

"The reference voltage generating circuit 221 includes a resistance 221*a* and serially connected plural (n) NMOS transistors 221*b*–221*n*. The resistance 221*a* is connected at an end to the node N2 and at the other end to a node N3. The NMOS transistor 221*n* is connected at a source to the ground. The node N3 is connected to a reverse input terminal of the comparator 222 via transfer gate 224 and to a gate electrode of the NMOS transistor 221*b*. The reference voltage generating circuit 221 generates a reference voltage VREF corresponding to the sum of threshold voltages of the NMOS transistors 221*b*–221*n*. The reference voltage VREF is supplied to the node N3, when a system supply voltage VCC is applied to the connection pad 211. The reference voltage generating circuit 221 is connected at an output terminal through the transfer gate 224 to a reverse input terminal of the comparator 222. The reference voltage generating circuit 221 generates a reference voltage VREF which corresponds to an optimum operation voltage of the memory circuit 140."

The transfer gate 224 is connected at a control terminal to the connection pad 213. The transfer gate 224 turns off when a high level "H" voltage is applied to the control terminal and turns on when a low level "L" voltage is applied to the control terminal. The connection pad 213 is connected through the resistance 225 to the ground and to a gate electrode of the NMOS transistor 226. The NMOS transistor 226 is connected at a source to the ground and at a drain to the reverse input terminal of the comparator 222.

The comparator 222 is connected at a non-reverse input terminal to the node N1 and at an output terminal to a gate electrode of the PMOS transistor 223. The comparator 222 compares the internal supply voltage IVCC to the reference voltage VREF. The PMOS transistor 223 is connected at a source to a node N2 and at a drain to the node N1. The comparator 222 is connected at a power terminal to the node N2, which is connected to the connection pad 211.

The output circuit 150 is supplied with a system supply voltage VCC from the connection pad 211, which is connected to a lead frame 201 by a conductive wire 102.

Next, the operation of the IC 200 is described for two different cases using a system supply voltage of (1) standard supply voltage and (2) lower supply voltage.

(1) For Standard System Supply Voltage

When a system supply voltage VCC corresponding to a standard supply voltage of 5V is used, the connection pads 212 and 213 are not connected to the lead frame 201. Since a control voltage at the pad 213 is pulled down by the resistance to a low level "L", the transfer gate 224 and NMOS transistor 226 are turned on and off, respectively. The system supply voltage VCC applied to the lead frame 201 is supplied via the conductive wire 202 to the connection pad 211. The system supply voltage VCC is supplied to the voltage lowering circuit 220 and output circuit 150. The system supply voltage VCC is decreased or lowered with the PMOS transistor 223 to generate an internal supply voltage IVCC to be supplied to the input circuit 130 and memory circuit 140.

When the internal supply voltage IVCC is higher than the reference voltage, the comparator 222 outputs a higher level signal, so that a channel resistance of the PMOS transistor 223 is increased. As a result, the internal supply voltage IVCC is controlled to be lowered, since a voltage drop at the PMOS transistor 223 is increased.

When the internal supply voltage IVCC is lower than the reference voltage VREF, the comparator 222 outputs a lower level signal, so that a channel resistance of the PMOS transistor 223 is decreased. As a result, the internal supply voltage IVCC is controlled to be increased, since a voltage drop at the PMOS transistor 223 is decreased. According to such a feed-back control, the internal supply voltage IVCC is controlled to correspond or be identical to the reference voltage VREF.

The internal supply voltage IVCC is supplied to the input circuit 130 and memory circuit 140, while the system supply voltage VCC is supplied to the output circuit 150 for matching with external circuits.

(2) For Lower System Supply Voltage

When a lower supply voltage, for example 2V, is used as a system supply voltage VCC, the connection pads 212 and 213 are connected with conductive wires 203 and 204 to the lead frame 201, respectively.

The system supply voltage of 2V applied to the lead frame 201 is supplied to all the connection pads 211–213 through the conductive wires 211-213, respectively. In the voltage lowering circuit 220, when the system supply voltage VCC is applied to the pad 213, the transfer gate 224 and NMOS transistor 226 are turned off and on, respectively; and a low level signal "L" is supplied to the reverse input terminal of the comparator 222. As a result, the comparator 222 keeps outputting a high level signal "H", so that no comparing process is carried out. At this time, the PMOS transistor 223 is turned off.

The system supply voltage VCC at the connection pad 211 is supplied to the voltage lowering circuit 220 and output circuit 150. The system supply voltage VCC at the connection pad 212 is supplied via the node N1 to the input circuit 130 and memory circuit 140 regardless of the condition or function of the voltage lowering circuit 220. In other words, the system supply voltage VCC is directly supplied to the input circuit 230, memory circuit 140 and output circuit 150 without any level control.

In the IC 200 according to the second preferred embodiment, when the system supply voltage VCC is low in level, the system supply voltage VCC is supplied to the connection pad 212 through the conductive wire 203. Accordingly, the IC 200 can be used for two different levels of system supply voltage without any change of pattern design. Further, when the system supply voltage VCC is low, the system supply voltage VCC is directly supplied to the memory circuit 140 without lowering or dropping of the voltage; and therefore, it can be avoided that the operation speed of the IC 200 is lowered. In addition, when the system supply voltage VCC is not higher than the optimum voltage of the memory circuit 140, the voltage lowering circuit is turned off. Therefore, power consumption of the voltage lowering circuit 220 is decreased.

According to the present invention, the following changes, modification or revises can be made:

(a) The present invention is not only applicable to memory ICs but also to other ICs having a voltage lowering circuit.

(b) System supply voltage and internal supply voltage are not limited by the above-described embodiments, and they can be other than 5V and 2V.

(c) The circuitry of the voltage lowering circuits 120 and 220 can be changed as long as having a function to lower the system supply voltage VCC to an internal supply voltage IVCC.

What is claimed is:

1. A method for generating an internal supply voltage to be used for an internal circuit in a semiconductor integrated circuit, comprising:

lowering a system supply voltage, supplied from an external supply circuit, to generate an internal supply voltage for the internal circuit when the system supply voltage is higher than a breakdown voltage of the internal circuit; and supplying the system supply voltage directly to the internal circuit when the system supply voltage is not higher than the breakdown voltage of the internal circuit.

2. A method according to claim 1, further comprising:

prohibiting said lowering a system supply voltage, when the system supply voltage is not higher than the breakdown voltage of the internal circuit.

3. A semiconductor integrated circuit, comprising:

an internal circuit having a breakdown voltage; and a voltage lowering circuit which lowers a system supply voltage that is supplied from an external supply circuit, when the system supply voltage is higher than the breakdown voltage of the internal circuit, to generate an internal supply voltage for the internal circuit, wherein the system supply voltage is supplied directly to the internal circuit when the system supply voltage is not higher than the breakdown voltage of the internal circuit.

4. A semiconductor integrated circuit according to claim 3, further comprising:

an output circuit which is connected to an external circuit, which operates at the system supply voltage, and is supplied with the system supply voltage regardless of the breakdown voltage of the internal circuit.

5. A semiconductor integrated circuit according to claim 3, further comprising:

a first electrode at which the system supply voltage is applied and which is connected through the voltage lowering circuit to the internal circuit; and a second electrode at which the system supply voltage is applied and which is connected to the internal circuit.

6. A semiconductor integrated circuit according to claim 5, wherein the first electrode is always connected to the external supply circuit, and the second electrode is connected to the external supply circuit only when the system supply voltage is not higher than the breakdown voltage of the internal circuit.

7. A semiconductor integrated circuit according to claim 3, wherein the voltage lowering circuit comprises:

(1) a reference voltage generating circuit which generates a reference voltage, at which the internal circuit operates properly;

(2) a comparator which compares the internal supply voltage to the reference voltage; and (3) a voltage control circuit which controls the internal supply voltage in response to an output signal of the comparator so that the internal supply voltage becomes equal to the reference voltage.

8. A semiconductor integrated circuit, comprising:

a voltage lowering circuit which lowers a system supply voltage that is supplied from an external supply circuit, to provide an internal supply voltage;

an internal circuit having a breakdown voltage;

a first electrode at which the system supply voltage is applied and which is connected through the voltage lowering circuit to the internal circuit;

a second electrode at which the system supply voltage is applied and which is connected to the internal circuit; and an output circuit which is connected to the first electrode and to an external circuit, and which operates at the system supply voltage, wherein the voltage lowering circuit comprises (1) a reference voltage generating circuit which generates a reference voltage, at which the internal circuit operates properly;

(2) a comparator which compares the internal supply voltage to the reference voltage; and (3) a voltage control circuit which controls the internal supply voltage in response to an output signal of the comparator so that the internal supply voltage becomes equal to the reference voltage, the second electrode is connected to the external supply circuit when the system supply voltage is not higher than the breakdown voltage of the internal circuit so that the system supply voltage is directly supplied to the internal circuit.

9. A semiconductor integrated circuit according to claim 3, further comprising:

an operation control circuit which prohibits operation of the voltage lowering circuit, when the system supply voltage is not higher than the breakdown voltage of the internal circuit.

10. A semiconductor integrated circuit according to claim 9, further comprising:

an output circuit which is connected to an external circuit, which operates at the system supply voltage, and is supplied with the system supply voltage regardless of the breakdown voltage of the internal circuit.

11. A semiconductor integrated circuit according to claim 9, further comprising:

a first electrode at which the system supply voltage is applied and which is connected through the voltage lowering circuit to the internal circuit; and a second electrode at which the system supply voltage is applied and which is connected to the internal circuit.

12. A semiconductor integrated circuit according to claim 11, wherein the first electrode is always connected to the external supply circuit, and the second electrode is connected to the external supply circuit only when the system supply voltage is not higher than the breakdown voltage of the internal circuit.

13. A semiconductor integrated circuit according to claim 9, wherein the voltage lowering circuit comprises:

(1) a reference voltage generating circuit which generates a reference voltage, at which the internal circuit operates properly;

(2) a comparator which compares the internal supply voltage to the reference voltage; and (3) a voltage control circuit which controls the internal supply voltage in response to an output signal of the comparator so that the internal supply voltage becomes equal to the reference voltage.

14. A semiconductor integrated circuit according to claim 9, further comprising:

a third electrode which is connected to the external supply circuit, when the system supply voltage is not higher than the breakdown voltage of the internal circuit, wherein the operation control circuit comprises a transfer gate and a transistor both of which operate in response to the system supply voltage.

15. A semiconductor integrated circuit, comprising:

a voltage lowering circuit which lowers a system supply voltage that is supplied from an external supply circuit, to provide an internal supply voltage;

an internal circuit having a breakdown voltage;

a first electrode at which the system supply voltage is applied and which is connected through the voltage lowering circuit to the internal circuit;

a second electrode at which the system supply voltage is applied and which is connected to the internal circuit;

an output circuit which is connected to the first electrode and to an circuit, and which operates at the system supply voltage, a third electrode which is connected to the external supply circuit, when the system supply voltage is not higher than the breakdown voltage of the internal circuit; and an operation control circuit which prohibits operation of the voltage lowering circuit, when the system supply voltage is not higher than the breakdown voltage of the internal circuit, wherein the voltage lowering circuit comprises (1) a reference voltage generating circuit which generates a reference voltage, at which the internal circuit operates properly;

(2) a comparator which compares the internal supply voltage to the reference voltage; and (3) a voltage control circuit which controls the internal supply voltage in response to an output signal of the comparator so that the internal supply voltage becomes equal to the reference voltage, the operation control circuit comprises a transfer gate and transistor both of which operate in response to the system supply voltage supplied via the third electrode, and the second electrode is connected to the external supply circuit when the system supply voltage is not higher than the breakdown voltage of the internal circuits so that the system supply voltage is directly supplied to the internal circuit.

* * * * *